United States Patent [19]

Knauss

[11] Patent Number: 4,949,556

[45] Date of Patent: Aug. 21, 1990

[54] HEATING MEANS FOR WASHING SOLUTIONS IN CLEANING MACHINES

[75] Inventor: Hermann Knauss, Oberderdingen, Fed. Rep. of Germany

[73] Assignee: E.G.O. Elektro-Gerate Blanc u. Fischer, Fed. Rep. of Germany

[21] Appl. No.: 865,163

[22] Filed: May 20, 1986

[30] Foreign Application Priority Data

May 23, 1985 [DE] Fed. Rep. of Germany ..... 3518565

[51] Int. Cl.[5] ..... D06F 1/08

[52] U.S. Cl. ..... 68/16; 68/208; 68/191; 219/201; 219/336

[58] Field of Search ..... 68/16, 208, 191, 193, 68/23.1; 134/105, 107, 186, 108, 106, 35; 219/201, 296, 297, 300, 301, 336; 135/564

[56] References Cited

U.S. PATENT DOCUMENTS

| | | | |
|---|---|---|---|
| 1,376,227 | 4/1921 | Rabezzana | 68/193 X |
| 1,778,620 | 10/1930 | Barta | 134/186 UX |
| 2,132,891 | 10/1938 | Dale | 68/191 X |
| 2,478,814 | 8/1949 | Ferris | 134/106 X |
| 2,780,086 | 2/1957 | Dunlap | 68/23.1 |
| 2,914,935 | 12/1959 | Sampsel | 68/16 X |
| 3,049,136 | 8/1962 | Van Scoyk | 134/108 |
| 3,072,129 | 1/1963 | Seal | 134/108 X |
| 3,378,673 | 4/1968 | Jenkins . | |
| 3,378,933 | 4/1968 | Jenkins | 134/107 X |
| 4,169,978 | 10/1979 | Hauslein | 219/292 |
| 4,401,156 | 8/1983 | Wojtecki et al. | 219/301 |
| 4,625,096 | 11/1986 | Fltecher | 219/296 X |
| 4,644,140 | 2/1987 | Hillinger | 219/301 |

FOREIGN PATENT DOCUMENTS

| | | |
|---|---|---|
| 6604971 | 7/1968 | Fed. Rep. of Germany . |
| 1898429 | 3/1985 | Fed. Rep. of Germany . |
| 1374218 | 11/1962 | France . |
| 229126 | 5/1985 | Japan . |
| 477635 | 1/1938 | United Kingdom . |
| 658685 | 10/1951 | United Kingdom . |

*Primary Examiner*—Frankie L. Stinson
*Attorney, Agent, or Firm*—Steele, Gould & Fried

[57] ABSTRACT

A cleaning machine, such as a washing machine, is provided in the bottom region of its wet chamber with an outlet and an intake connected thereto immediately above a feed pump, adjacent to which a heating section with an electric heating element located outside the wet region is provided, in such a way that a circulating duct is formed which leads through the wet chamber, the outlet and back to the inlet to the inlet side of the feed pump, in which the washing solution is carried in circuit form under thermosiphonic effect, so that the washing solution is heated and portions of the cleaning agent added to the washing solution and which tend to sink are dissolved.

18 Claims, 2 Drawing Sheets

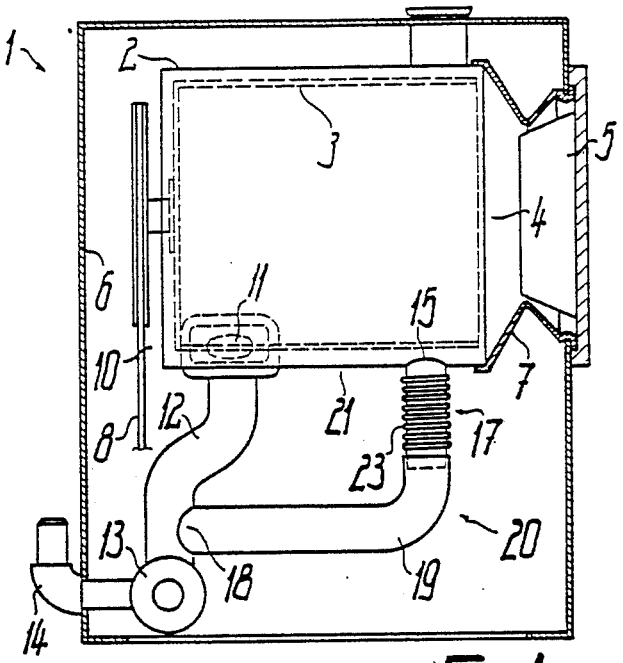
Fig. 1
Fig. 2
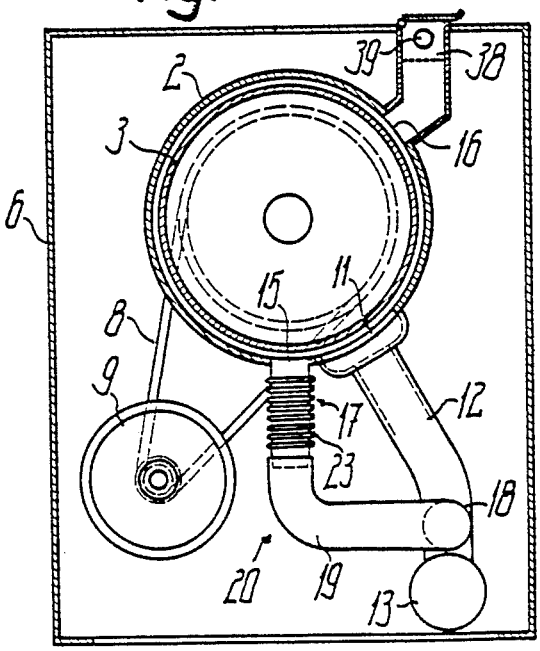

HEATING MEANS FOR WASHING SOLUTIONS IN CLEANING MACHINES

BACKGROUND OF THE INVENTION

The present invention relates to a heating means for washing solutions in cleaning machines, such as washing machines, rinsing machines or the like, which are provided with a wet chamber having an outlet and an intake, as well as an electric heating element more particularly in the form of a tubular heater.

It is frequently disadvantageous in such cleaning machines which, apart from industrial purposes, can in particular be constructed as domestic machines, that the heating element is located within the wet chamber or the washing solution flows round it. Apart from relatively high loading or stressing, e.g. also through contaminants deposited thereon, there is usually a space-consuming construction, particularly due to the fact that it is necessary to provide a separate zone for housing the heating element in the wet chamber and this increases the minimum filling of the latter. With increased filling volume, there is also an increased need for cleaning agents, such as e.g. detergents or rinsing agents, if the same cleaning agent concentration is to be obtained as compared with a reduced fill. In the case of the known constructions and in particular in the case of washing machines, there is frequently a detergent need increase of at least 10%, particularly as the safety distance between heating element and rotating washing drum must be made relatively large. The need for cleaning agents frequently also increases as a result of the fact that the cleaning agent, particularly if added to the water in powder form, does not immediately dissolve and can therefore sink into the outlet used for emptying purposes. No flow movements take place in the duct leading away from the outlet and which is usually connected to the feed pump used for emptying the wet chamber, during the normal operation of the latter, i.e. whenever an emptying operation is not taking place, so that the cleaning agent collects in this area and is no longer supplied to the cleaning process in the wet chamber.

Apart from an increased demand for cleaning agents, this also leads to sticking or caking over in the emptying duct, as well as in the feed pump and it is not possible to remove the same completely during standard emptying processes and gradual clogging or more or less marked closure of the emptying passages of the wet chamber can occur.

SUMMARY OF THE INVENTION

An object of the present invention is to provide heating means of the aforementioned type, which in the case of simple construction and high operational reliability, ensures that a maximum amount of the cleaning agent supplied to the washing solution is dissolved.

In the case of a heating, means of the aforementioned type, this object is achieved in that the heating element is kept dry and tightly separated from the wet chamber, being fitted in good heat conducting connection to a circulating duct in circuit arrangement with the outlet, intake and wet chamber. Thus, particularly during heating up, the washing solution can be guided in a rinsing flow in an outlet provided for this purpose or that which is already present for emptying the wet chamber, as well as in a duct leading away from the same, so that any undissolved parts of the cleaning agent or higher cleaning agent concentration collections are permanently circulated by the flow and are consequently mixed under the remaining washing solution in such a way that a homogeneous concentration of said washing solution is ensured.

It is admittedly conceivable in the case of certain wet chamber configurations for the heating element to be advantageously located within the wet chamber, but kept dry with respect thereto by a tight protective and heat transfer jacket. However, according to a particularly appropriate construction of the invention the heating element and/or circulating duct is located substantially completely outside the wet chamber, preferably below the bottom thereof, so that the complete interior of the wet chamber is free from heating elements and ducts and is consequently available for operation with the washing solution.

It is conceivable to produce the washing solution flow in the circuit or circulating duct by a separate feed means, which can e.g. be the feed pump connected in the emptying duct and which is then appropriately connected on the outlet side via a two-way valve by a discharge duct in the circulating duct and during operation in the latter operates with a substantially reduced delivery or feed performance. In the case of a much simpler embodiment of the invention, which also ensures high operational reliability and requires no special maintenance, the flow in the circuit or the circulating duct is produced by thermosiphonic effect. It is particularly advantageous for this if, according to a further development of the invention, the heating element is particularly exclusively arranged on a heating portion of the circulating duct rising to the intake and which preferably passes approximately vertically up to the intake and/or issues in the lowest region of the wet chamber. Independently of the thermosiphonic effect, this leads to a flow which flows particularly favourably through the wet chamber.

According to another feature of the invention, the heating element is positioned immediately adjacent to the intake or wet chamber, so that the washing solution can pass directly to the wet chamber after heating and without ant significant thermal losses. In any case, it is advantageous if the heat transfer from heating element to washing solution takes place over a greater flow distance, so that the heating element appropriately extends over a circulating duct length, which a is greater than its diameter in the vicinity of the heating element.

To further improve the circuit flow through the wet chamber, particularly to the extent that said flow passes through said chamber with a maximum area, the circuit feed intake to the wet chamber is displaced with respect to the associated outlet, particularly being roughly at the same height in the vicinity of a wet chamber end facing the outlet. The outlet belonging to the circuit feed can be formed by two or more spaced outlet ports, which appropriately lead into the same circulating duct, instead of a single outlet port.

If in circuit operation, the emptying duct of the wet chamber forms a component of the circulating duct, said emptying duct appropriately in its lowest region or on the inlet side passes into the circulating duct immediately adjacent to the feed pump connected into the emptying duct, so that a duct branch leading to the heating section is appropriately connected to the discharge duct in this area. This duct branch appropriately does not rise in the associated flow direction, starting from the connection point, but can have a downward or horizontal alignment, so that cleaning agent residues are reliably rinsed out of the discharge duct. On constructing the circulating duct in such a way that very high flow velocities are obtained, it is also conceivable for the duct branch to rise slightly in this region.

The inventive construction also leads to a very good efficiency of the heating means. This can be further improved in that the heating element is arranged helically in closely adjacent form on the outer circumference of the heating section. In addition thereto or in place thereof, the heating element is appropriately fixed to the heating section by a soldered joint or the like.

A particularly advantageous further development of the invention is obtained in that in the area most remote from the intake, i.e. generally in the lower region of the heating section and in particular with a limited distance below the heating element, a temperature sensor of a temperature switch or thermostat or the like is arranged in good heat conducting connection and is preferably formed by the sensing bar of a hydraulic expansion system at least partly surrounding the heating section circumference. Compared with the possible arrangement of the temperature sensor in a higher region, e.g. between sections or above the heating element, this construction has the important advantage that the washing solution temperature is detected at that point where it has its lowest temperature, namely shortly before it is heated up again by the heating element. This ensures a very precise washing solution temperature. Even if during the operation of the heating element, the water level in the wet chamber drops below a predetermined level and consequently the circulating flow in the circuit system stops, said temperature sensor can not run dry, i.e. pass into an area above the water level, because the washing solution initially present in the heating section is in this case so rapidly heated to the predetermined operating temperature that the heating element is switched off via the thermostat before the washing solution has dropped below the temperature sensor. The latter can be arranged in such a way that it directly senses the heat of the heating element or indirectly senses the same via the heating section and is consequently precisely controlled. The disconnection temperature for an advantageous setting can be over 100° C. and is e.g. approximately 120° C. As a result of the high reliability obtained, the cleaning machine or wet chamber can be made from much less heat-resistant materials than hitherto. For example, in the case of a washing machine, the washing drum can be made from plastic. The heating element is also exposed to much lower stresses, because even under the least favourable circumstances it does not glow.

In order to be able to fit the temperature sensor in an easily replaceable manner and also fit it with a good heat conducting connection, it is advantageously surrounded in a mounting support fitted to the heating section in good heat conducting contact, the mounting support preferably being formed by a U-profile engaging by its profile cross-web on the heating section and whose profile legs closely surround the temperature sensor and are bent against its circumference. However, it is also conceivable for the mounting support to be constituted by a tube, into which the temperature sensor is introduced with a limited radial tolerance, i.e. for example with a slight sliding fit.

In order to greatly simplify installation and maintenance of the heating means, the heating section is formed by a separate and in particular detachable pipe section which, together with the heating element and optionally the temperature sensor, forms a closed assembly, which can be replaced at any time in the case of a detachable arrangement. The heating element or heating section can also be surrounded on its external circumference by an insulating jacket, which further improves efficiency.

This and further features of preferred further developments of the invention can be gathered from the description and drawings, the individual features can be realised individually or in the form of subcombinations in an embodiment of the invention and in other fields.

BRIEF DESCRIPTION OF THE DRAWINGS

The invention is described in greater detail hereinafter relative to non-limitative embodiments and the attached drawings, wherein show :

FIG. 1, a washing machine provided with a heating means according to the invention, partly in vertical section.

FIG. 2, the washing machine according to FIG. 1 in part sectional view from the right.

Figure 3:
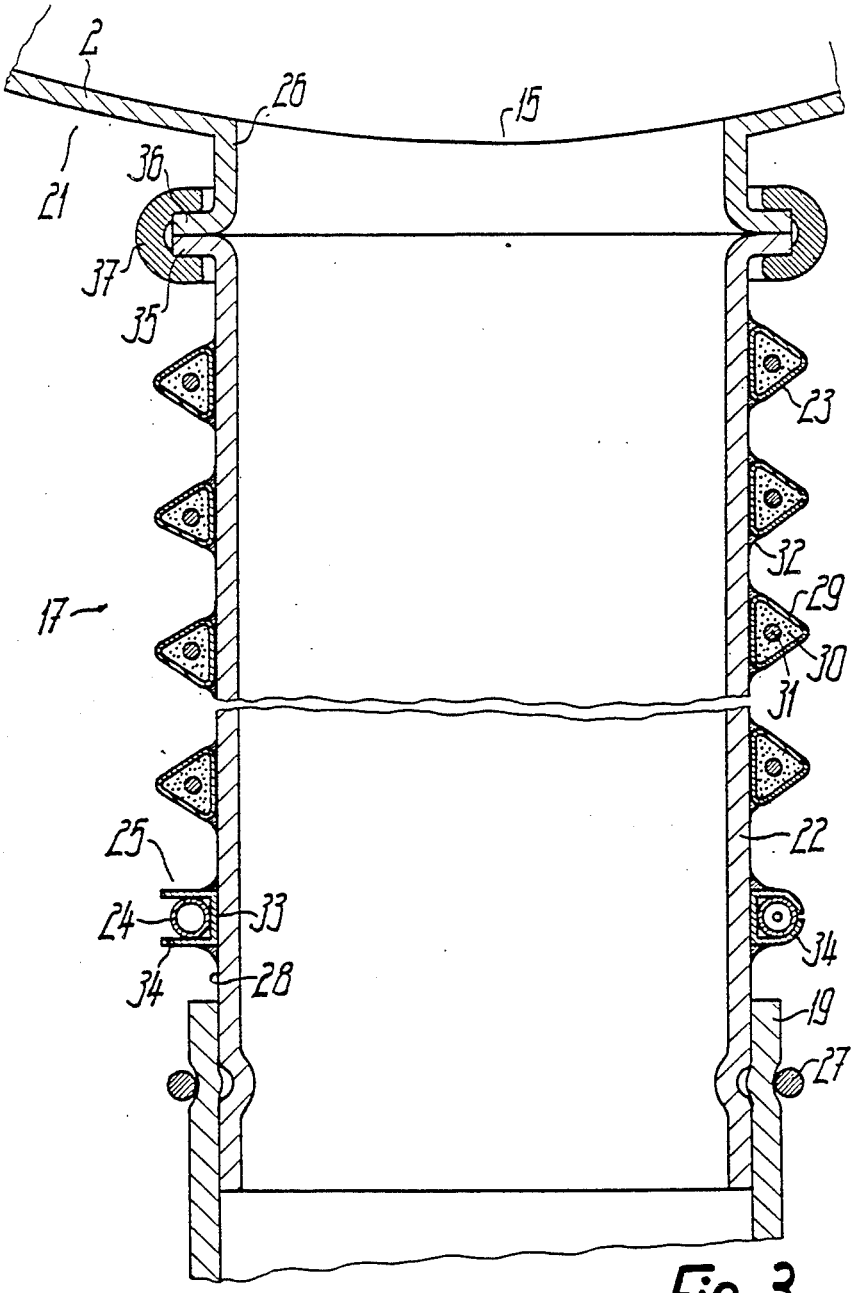

FIG..3, a detail of FIG. 2 on a larger scale and in axial section.

DETAILED DESCRIPTION OF THE PREFERRED EMBODIMENTS

As shown in FIGS. 1 to 3, an inventive cleaning machine, in the form of a washing machine in the represented embodiment, has a wet chamber 2, which closely surrounds with a relatively limited gap clearance a washing drum 3, at least from the zone below the horizontal rotation axis thereof and in the represented case is arranged as a rotary body closely around the cylindrical washing drum 3. The front end 4 of wet chamber 2, like that of the washing drum 3 is open and closable by a fixed door 5, which is located on the front wall of a machine casing 6. A sealing bellows 7 is provided for sealing wet chamber 2 relative to the front wall. A shaft of the washing drum 3 leads out of the base of the wet chamber 2 provided at the rear end and is drive-connected via a drive means 8, e.g. a belt drive to a drive motor 9. Wet chamber 2 can be resiliently mounted in machine casing 6 together with the drive motor 9 positioned below it, so that vibrations, particularly unbalance vibrations cannot be transferred to the casing in undamped manner.

Roughly in the lowest region of wet chamber 2 and close to its closed end 10, said chamber is provided with an outlet 11 in the form of an opening passing through its wall, which is connected on the inlet side via an emptying duct 12 leading exclusively downwards therefrom to the top of a feed pump 13 arranged below wet chamber 2 in the bottom region of casing 6. The discharge outlet of feed pump 13 leads to a discharge connection 14, to which is e.g connected a waste water or sewage pipe. The emptying duct 12 is appropriately flexible over at least part and in particular over its entire length and is in particular formed by a hose, which is detachably connected to the connecting piece of outlet 11 and feed pump 13.

Adjacent to the other end and in the represented case the front end 4, one of two intakes 15, 16 is connected to wet chamber 2 in the deepest region of the latter and in vertically upwardly directed manner and which, like outlet 11, immediately faces the perforated water-permeable circumference of washing drum 3. This lower intake 15 forms the outlet for a tubular heating section 17, which is fixed to the bottom of wet chamber 2 and connected on the inlet side to outlet 11. In the represented embodiment a duct branch 18 is provided for this purpose immediately above the inlet side of feed pump 13 or its feed rotor, said branch being at right angles to the associated portion of the outlet or emptying duct 12 with intersecting central axes or roughly horizontal, said outlet duct portion being appropriately vertical. The duct branch 18 can be formed by an angular or T-shaped connecting piece with two ends integrated with feed pump 13 and whereof one is line-connected via said flexible hose or the like to the outlet 11 and the other is connected on the inlet side to the heating section 17 via a connecting duct 19. Connecting duct 19 is appropriately also flexible and is e.g. formed by a hose. The connecting duct runs from the duct branched 18 over most of its length without any significant rise or is horizontal and then passes over a short, upwardly bent portion to the lower end of heating section 17. As a result of the described line paths, a circulating duct 20 for leading the washing solution in wet chamber 2 in circuit from and back into said chamber is formed and which through outlet 11, emptying duct 12, duct branch 18, connecting duct 19, heating section 17, intake 15 and within the wet chamber 2 to outlet 11 again. In operation, the washing drum 3 forms a stirring means for producing eddy flows in the associated portion of the circulating duct 20, so that the latter contains an eddy flow section. Apart from the portion of the circulating duct 20 leading through the wet chamber 2, all its other portions are located on the bottom 21 of wet chamber 2.

As shown in FIGS. 1 to 3, heating section 17 is substantially formed by a preferably cylindrical pipe piece 22 having a constant cross-section over its entire length, together with an electric heating element 23, a temperature sensor 24 and a mounting support 25 associated therewith. The vertical pipe pieces 22, which is coaxial with connecting piece 26 and fixed to the lower end of a vertical connecting piece 26 forming intake 15 has a length which is almost twice its diameter. Connecting duct 19 is mounted on its lower end and is e.g. secured by a removable spring clamp ring 27. In the form of a tubular heater, heating element 23 is helically closely around the outer circumference of heating section 17 or pipe piece 22, being position over the entire free length of the pipe piece 22, the internal spacing between adjacent turns being roughly the same as the associated cross-sectional extension of heating element 23. The tubular heater has a metallic jacket 29, which is filled with a heat-resistant insulating material, in which is embedded as a a heating wire and electrical resistance wire which is not in contact with jacket 29. In the represented embodiment, the external cross-section of heating element 23 is flattened at least at the engagement side belonging to pipe piece 22, so that a large-surface engagement and therefore a very good heat transfer is ensured. As shown in FIG. 3, the external cross-section of heating element 23 is almost equilateral triangular. The heating element, which can e.g. be applied in pretensioned form to the outer circumference 28 of pipe piece 22 is additionally fixed to pipe piece 22 by a soldered joint 32 running virtually over its entire length, which further improves the heat transfer.

With a spacing roughly corresponding to the spacing between adjacent turns of the heating element 23, immediately below heating element 23 the temperature sensor 24 is arranged in the form of a sensor tube of an expansion system. The mounting support 25 is cross-sectionally U-shaped and is fixed, preferably by means of a soldered joint in a ring zone and in closely engaging manner to the outer circumference 28 of pipe piece 22. The entire large surface of mounting support 25 engages on the outside circumference 28 by the exterior of its profile cross-web 33, in such a way that the roughly equally long or high profile legs 34 project radially outwards. The internal diameter of mounting support 25 is substantially the same as the external diameter of temperature sensor 24, which is placed in annular manner in mounting support 25 in such a way that it is in contact with the insides of both the profile cross-web 33 and both profile legs 34 substantially over the entire length thereof.

After placing the temperature sensor 24 in the initially open mounting support 25, of the left-hand part of figure, the profile legs 34 are bent against one another around the temperature sensor 24, so that, as shown to the right in fig 3, they closely embraced temperature sensor 24 roughly over the half of its circumferential surface remote from outer circumference 28 and the longitudinal edges thereof are adjacent in almost gap-free manner.

The upper, flange ring-like, outwardly bent end 35 of pipe piece 22 or heating section 17 is detachably fixed to the correspondingly constructed end 36 of the connecting piece 26 having the same internal cross-sections as the heating section 17 by the two engaging flange ends 35, 36 being jointly surrounded by an embracing, cross-sectionally approximately U-shaped elastic profile ring 37, which can e.g. be made from rubber. Connecting piece 26 is much shorter than heating section 17, so that the latter is immediately adjacent to the wall of wet chamber 2 or intake 15.

The inventive arrangement functions as follows. After the wet chamber 2 has been filled to a predetermined height by means of the further intake 16 issuing into the upper region thereof and optionally accompanied by the admixing of cleaning agent, the heating element 23 is switched on, so that the water in the heating section 17 of the circulating duct 20 filled with wet chamber 2 is heated and is fed upwards into the wet chamber 2 under the thermosiphonic effect. Corresponding to the intake into wet chamber 2, water flows out through outlet 11 and passes via the portion of circulating duct 20 located outside wet chamber 2 into the heating section 17 and therefore back into the wet chamber 2, so that the water or washing solution is passed in circuit form through the wet chamber and is simultaneously heated to the desired temperature. On reaching the desired temperature, heating element 23 is switched of by means of temperature sensor 24. During the heating of the water, the washing drum 3 can be intermittently or continuously in operation, i.e. it can perform rotary movements in alternating rotary directions. During the circuit feed of the water or washing solution, portions of the cleaning agent admixed with the washing solution which have sunk through the outlet 11 into the region above the rotor of feed pump 13 are sucked or rinsed into the duct branch 18 and supplied via heating section 17 back to the wet chamber 2. For emptying wet chamber 2, feed pump 13 is put into operation, so that the water or washing solution is completely pumped out via discharge connection 14, whose inlet side is lower than the remaining circulating duct 20. To ensure that the connecting duct 19 is also completely emptied, it can have a slight down gradient towards the feed pump 13 or duct branch 18.

The fresh water or washing solution intake 16 is e.g. connected to a flotation chamber 38 with at least one perforated wall, into which issues a fresh water inflow 39 and into which the cleaning agent is introduced in such a way that it is carried by the inflowing fresh water to intake 16 and consequently into wet chamber 2.

The heating section 17 is arranged in fixed or movement-free manner opposite wet chamber 2. Opposite the same, the feed pump is appropriately arranged in fixed manner on casing 6 or the machine base and opposite the same wet chamber 2 is movably mounted in vibration-damped manner. The duct portions connecting the wet chamber 2 to the fixed duct connections provided e.g. on the feed pump 13 consequently also vibrate when the wet chamber 2 is vibrating, which further improves the dissolving of cleaning agent constituents.

The heating means as described can also be applied to other machines than such using washing solutions, especially to such machines containing solutable components in their liquid.

What is claimed is:

1. A heating means for heating washing liquids in a washing machine, said heating means comprising:

a wet chamber for receiving articles to be washed, said wet chamber having a liquid outlet, a liquid inlet and a lowest region;

a circuit duct connecting said liquid outlet to said liquid inlet, a liquid circuit conduit being defined by said circuit duct, the liquid inlet, the wet chamber and the liquid outlet;

a heating duct operable to heat the washing liquid when circulating in said liquid circuit conduit; and a drain pump having a pump inlet connected to said circuit duct, wherein the pump inlet of the drain pump is located directly adjacent to, but outside of, the circuit duct, thereby avoiding a dead leg between the circuit conduit and the pump inlet where sediment tends to occur said liquid inlet and said liquid outlet being located substantially at a same level, said drain pump being located outside said circuit duct.

2. A heating means according to claim 1, wherein said circuit duct has a drain portion connecting said liquid outlet to said pump inlet of the drain pump, said drain duct portion extending exclusively in a downward direction from said liquid outlet to said pump inlet.

3. A heating means according to claim 2, wherein said drain duct portion connecting said liquid outlet to said duct branch connection is at least partly flexible.

4. A heating means according to claim 1, wherein a duct branch connection is provided directly adjacent to said pump inlet, said duct branch connection being connected to said heating duct by means of a connecting duct.

5. A heating means according to claim 4, wherein said duct branch connection is integrated with the drain pump.

6. A heating means according to claim 4, wherein the connecting duct connecting the duct branch connection to the heating duct is flexible.

7. A heating means according to claim 4, wherein said heating duct is formed by a pipe section detachably connected to the wet chamber.

8. A heating means according to claim 7, wherein the pipe section is connected to a connecting stud having an internal cross-section equal to that of the heating duct.

9. A heating means according to claim 7, wherein a lower end of the heating duct is connected to the connecting duct by means of a detachable coupling having a clamp ring.

10. A heating means according to claim 1, wherein the heating duct rises substantially vertically in a downward direction to the liquid inlet of the wet chamber, said heating duct bearing an electrical heating element located directly adjacent to the liquid inlet of the wet chamber.

11. A heating means according to claim 1, wherein the heating element is arranged in closely engaging helical form on an outer circumference of the heating duct, said heating element being fixed by a soldered joint to the heating duct.

12. A heating means according to claim 1, wherein the liquid inlet and the liquid outlet of the wet chamber are displaced with respect to each other and located substantially at the same height level, the liquid inlet being located in the vicinity of a wet chamber end facing the liquid outlet.

13. A heating means according to claim 1, wherein the cleaning machine is a laundry machine.

14. A heating means for heating washing liquids in a washing machine, said heating means comprising:

a wet chamber for receiving articles to be washed, said wet chamber having a liquid outlet, a liquid inlet and a lowest region;

a circuit duct connecting said liquid outlet to said liquid inlet, a liquid circuit conduit being defined by said circuit duct, the liquid inlet, the wet chamber and the liquid outlet;

a heating duct operable to heat the washing liquid when circulating in said liquid circuit conduit; and, a drain pump having a pump inlet connected to said circuit duct, said drain pump having a top side, and wherein said pump inlet is provided on the top side of said drain pump, a drain duct portion of said circuit duct leading to said top side.

15. A heating means for heating washing liquids in a washing machine, said heating means comprising:

a wet chamber for receiving articles to be washed, said wet chamber having a liquid outlet, a liquid inlet and a lowest region;

a circuit duct connecting said liquid outlet to said liquid inlet, a liquid circuit conduit being defined by said circuit duct, the liquid inlet, the wet chamber and the liquid outlet;

a heating duct operable to heat the washing liquid when circulating in said liquid circuit conduit; and, a drain pump having a pump inlet connected to said circuit duct, wherein the drain pump is arranged as a liquid circulating pump for the liquid circuit conduit, a pump outlet of said drain pump being connectable to the circuit duct by means of a valve.

16. A heating means according to claim 1, 14 or 15, wherein said heating duct is provided in said circuit duct having an electrical heating element in thermally conductive relation with the washing liquid, means being provided for circulating said washing liquid in said liquid circuit conduit by thermosiphonic action.

17. A heating means according to claim 1, 14 or 15, wherein the heating duct defining said liquid inlet issues substantially into the lowest region of the wet chamber.

18. A heating means according to claim 1, 14 or 15, further comprising a heater element including a tubular heater having a flattened side for contacting the heating duct.

* * * * *